US006180301B1

(12) United States Patent
Mayo et al.

(10) Patent No.: US 6,180,301 B1
(45) **Date of Patent: *Jan. 30, 2001**

(54) TETRAFLUORO HYDROXYGALLIUM PHTHALOCYANINES AND PHOTOCONDUCTIVE IMAGING MEMBERS

(75) Inventors: James D. Mayo; Cheng-Kuo Hsiao, both of Mississauga (CA)

(73) Assignee: Xerox Corporation, Stamford, CT (US)

( * ) Notice: Under 35 U.S.C. 154(b), the term of this patent shall be extended for 729 days.

This patent is subject to a terminal disclaimer.

(21) Appl. No.: 08/510,730

(22) Filed: Aug. 3, 1995

(51) Int. Cl.[7] ..... G03G 5/047
(52) U.S. Cl. ..... 430/59.3; 430/78; 430/124
(58) Field of Search ..... 430/78, 124, 59.3

(56) References Cited

U.S. PATENT DOCUMENTS

| | | | | |
|---|---|---|---|---|
| 4,701,396 | * | 10/1987 | Hung et al. | 430/78 |
| 5,112,711 | * | 5/1992 | Nguyen et al. | 430/78 |
| 5,166,339 | | 11/1992 | Duff et al. | 540/141 |
| 5,189,155 | | 2/1993 | Mayo et al. | 540/141 |
| 5,189,156 | | 2/1993 | Mayo et al. | 540/141 |
| 5,302,479 | * | 4/1994 | Daimon et al. | 430/78 |
| 5,482,811 | * | 1/1996 | Keoshkerian et al. | 430/135 |

FOREIGN PATENT DOCUMENTS 1221459 9/1989 (JP) .

7-53559 * 2/1995 (JP) .

OTHER PUBLICATIONS

Cullity, B. D. Elements of X–ray Diffraction. Reading, MA: Addison–Wesley Publishing Co., Inc. pp. 3, 4, and 21, 1978.*

National Bureau of Standards. Tables for Conversion of X–ray Diffraction Angles to Interplanar Spacings. Washington: US Government Printing Office. pp. 1, 7, 21, 27, 41, 47, 61, 67, 81, 87, 10.1, 107, Sep. 1950.*

Klug, Harold and Leroy Alexander. X–ray Diffraction Procedures. New York: John–Wiley and Sons. p. 69, 1974.*

Chemical Abstracts 121:311974, 1994.*

Ladd, M. & R. Palmer. Structure Determination by X–Ray Crystallography. New York: Plenum Press. pp. 120–124, 1985.*

Bull, Soc. Chim. Fr., 23(1962), No. 2–Study of Some Phthalocyanine Derivatives, Discussion on the Various Routes of Preparation, etc., by Mrs. Denise Colaitis.

* cited by examiner

*Primary Examiner*—Christopher D. RoDee
(74) *Attorney, Agent, or Firm*—E. O. Palazzo

(57) ABSTRACT

A photoconductive imaging member comprised of a supporting substrate, a photogenerating layer, and a charge transport layer, and wherein said photogenerating layer is comprised of a mixture of a hydroxygallium phthalocyanine and a tetrafluoro hydroxygallium phthalocyanine.

22 Claims, 6 Drawing Sheets

TETRAFLUORO HYDROXYGALLIUM PHTHALOCYANINES AND PHOTOCONDUCTIVE IMAGING MEMBERS

BACKGROUND OF THE INVENTION

This invention is generally directed to hydroxygallium phthalocyanines and photoconductive imaging members thereof, and, more specifically, the present invention is directed to tetrafluoro substituted phthalocyanines, photoconductive imaging members thereof, and processes for the preparation thereof. In embodiments, the processes of the present invention comprise the reaction of fluorophthalonitrile with a gallium halide, preferably a gallium chloride in an organic solvent like N-methylpyrrolidone, a halonaphthalene such as 1-chloronaphthalene, quinoline, and preferably 1-chloronaphthalene, and the like to provide the precursor pigment tetrafluorohalogallium phthalocyanine, and preferably tetrafluorochlorogallium phthalocyanine, subsequently hydrolyzing or acid pasting the aforementioned precursor to preferably provide tetrafluoro hydroxygallium phthalocyanine Type I; and thereafter mixing the Type I in the presence of certain solvents, such as N,N-dimethylformamide, dimethylaminoethanol, isopropanol, and preferably N-methylpyrrolidone to enable a unique polymorphic form of tetrafluoro hydroxygallium phthalocyanine for each solvent that is used, including a very light sensitive Type V tetrafluoro hydroxygallium phthalocyanine. Embodiments of the present invention relate to certain tetrafluoro hydroxygallium phthalocyanines, such as Type I, II, III, IV, and V, processes thereof, and photoconductive imaging members thereof. Moreover, in embodiments the present invention relates to mixtures of tetrafluoro hydroxygallium phthalocyanines and hydroxygallium phthalocyanines, processes thereof, and photoconductive imaging members thereof.

With the present invention, in embodiments there is provided Type V tetrafluoro hydroxygallium phthalocyanine with an X-ray powder diffraction trace having a major peak at Bragg angles of 6.6, and minor peaks at 6.0, 13.4, 14.7, 15.9, 16.9, 26.1, and 27 degrees 2Θ; Type I tetrafluoro hydroxygallium phthalocyanine with an X-ray powder diffraction trace having a major peak at Bragg angles of 6.5, and minor peaks at 15.6, and 26.5 degrees 2Θ; Type II tetrafluoro hydroxygallium phthalocyanine with an X-ray powder diffraction trace having a major peak at Bragg angles of 6.6, and minor peaks at 12.7, 15.4, 26.3, and 27.0 degrees 2Θ; Type III tetrafluoro hydroxygallium phthalocyanine with an X-ray powder diffraction trace having a major peak at Bragg angles of 7.5, and minor peaks at 9.1, 15.6, 16.5, 19.5, 21.8, 22.6, and 27.3 degrees 2Θ; and Type IV tetrafluoro hydroxygallium phthalocyanine with an X-ray powder diffraction trace having a major peak at Bragg angles of 6.5, and minor peaks at 7.5, 15.2, 15.7, and 26.5 degrees 2Θ.

More specifically, in embodiments the process of the present invention comprises the formation of a precursor prepared by the reaction of 1 weight part, or weight percent gallium chloride with from about 1 weight part to about 10 weight parts, and preferably about 4 weight parts 4-fluorophthalonitrile in a solvent, such as quinoline, chloronaphthalene, or N-methylpyrrolidone, and which solvent is selected in an effective amount such as, for example, from about 5 weight parts to about 100 weight parts and preferably about 15 weight parts, for each part of gallium chloride that is used, to provide a pigment precursor tetrafluoro chlorogallium phthalocyanine, which is subsequently washed with a component, such as dimethylformamide, to provide the precursor tetrafluoro chlorogallium phthalocyanine as determined by X-ray powder diffraction with an X-ray powder diffraction trace having peaks at Bragg angles of 16.5, 25.5, 26.2, 27.3, and 28.8 and the highest peak at 7.0 degrees 2Θ; dissolving 1 weight part of the resulting precursor pigment tetrafluoro chlorogallium phthalocyanine in concentrated, about 94 percent, sulfuric acid, which acid is selected in various effective amounts, such as in an amount of from about 1 weight part to about 100 weight parts and in an embodiment about 25 weight parts, by stirring the pigment precursor tetrafluoro chlorogallium phthalocyanine in the acid for an effective period of time, for example from about 30 seconds to about 24 hours, and in an embodiment about 2 hours at a temperature of from about 0° C. to about 25° C., and preferably below about 10° C. in air or under an inert atmosphere, such as argon or nitrogen; adding the resulting mixture in a dropwise manner at a rate of about 0.5 milliliter per minute to about 10 milliliters per minute, and in an embodiment about 1 milliliter per minute to a stirred organic solvent, which can be a mixture comprised of from about 1 volume part to about 10 volume parts and preferably about 4 volume parts of concentrated aqueous ammonia solution (14.8 N) and from about 1 volume part to about 10 volume parts, and preferably about 6 volume parts of water for each volume part of acid like sulfuric acid that was used, which solvent mixture was chilled to a temperature of from about −25° C. to about 10° C. and in an embodiment about −5° C. while being stirred at a rate sufficient to create a vortex extending to the bottom of the flask containing the solvent mixture; isolating the resulting blue pigment by, for example, filtration; and washing the tetrafluoro hydroxygallium phthalocyanine product obtained with deionized water by redispersing and filtering from portions of deionized water, which portions are from about 10 volume parts to about 400 volume parts, and in an embodiment about 200 volume parts for each weight part of precursor pigment tetrafluoro chlorogallium phthalocyanine which was used. The product obtained as a wet cake, approximately 10 percent by weight pigment and 90 percent by weight water, can then be oven dried at a temperature of from about 40° C. to about 100° C. and in an embodiment about 50° C. for a period of from about 12 hours to about 1 week and in an embodiment about 24 hours The product, a dark blue solid, Type I tetrafluoro hydroxygallium phthalocyanine, had an X-ray diffraction pattern having major peaks at 6.9, 13.1, 16.4, 21.0, 26.4, and the highest peak at 6.9 degrees 2Θ. The resulting dried intermediate product, Type I tetrafluoro hydroxygallium phthalocyanine, can then be converted to different polymorphic forms by stirring in the presence of a solvent, present in an amount of from about 1 weight part to about 50 weight parts and in an embodiment about 15 weight parts per weight part of Type I tetrafluoro hydroxygallium phthalocyanine that was used, at room temperature, about 25° C., for a period of from about 2 hours to about 2 weeks, and in an embodiment about 1 week. The stirring can be effected with a magnetic stirrer, or in an embodiment by placing said pigment and said solvent in a sealed glass jar containing glass beads, 1 millimeter in diameter, present in an amount of from about 10 weight parts to about 100 weight parts and in an embodiment about 30 weight parts per weight part of Type I tetrafluoro hydroxygallium phthalocyanine that was used, and milling said pigment/solvent mixture on a ball mill. In one invention embodiment, there is used, for example, N,N-dimethylformamide as the solvent, which results in the product, Type II tetrafluoro hydroxygallium phthalocyanine. In another separate embodiment of the present invention, there is used, for example, dimethylaminoethanol as the solvent, which results in the product, Type III tetrafluoro hydroxygallium phthalocyanine. In another separate embodiment there is used, for example, isopropanol as the solvent, which results in the product, Type IV tetrafluoro hydroxygallium phthalocyanine. In another separate embodiment there is used, for example, N-methylpyrrolidone as the solvent, which results in the product, Type V tetrafluoro hydroxygallium phthalocyanine.

Examples of advantages associated with the present invention in embodiments thereof include excellent dispersion quality, as observed by careful visual inspection of the coating of the photogenerating layer containing the pigment Type V tetrafluoro hydroxygallium phthalocyanine; broad spectral response of the Type V pigment extending into the infrared region of the spectrum, and in embodiments from about 500 to about 900 nanometers, excellent xerographic characteristics, such as high photosensitivity, for example from about 75 to about 125, and in an embodiment about 100 V $cm^2$/erg, low dark decay, for example from about 0 to about 20, and in an embodiment about 11 volts/second, and low residual voltage of, for example, from about 0 to about 20, and in an embodiment about 11 volts; compatibility with HOGaPc; and the potential for one pot preparation.

The tetrafluoro hydroxygallium phthalocyanines, especially the Type V obtained, can be selected as organic photogenerator pigments in layered photoresponsive imaging members with charge transport layers, especially hole transport layers containing hole transport molecules such as known tertiary aryl amines. The aforementioned photoresponsive, or photoconductive imaging members can be negatively charged when the photogenerating layer is situated between the hole transport layer and the substrate, or positively charged when the hole transport layer is situated between the photogenerating layer and the supporting substrate. The layered photoconductive imaging members can be selected for a number of different known imaging and printing processes including, for example, electrophotographic imaging processes, especially xerographic imaging and printing processes wherein negatively charged or positively charged images are rendered visible using toner compositions of appropriate charge polarity. In general, the imaging members are sensitive in the wavelength region of from about 550 to about 900 nanometers, and in particular, from 700 to about 850 nanometers, thus diode lasers can be selected as the light source.

In *Bull. Soc. Chim. Fr.,* 23 (1962), there is illustrated the preparation of hydroxygallium phthalocyanine via the precursor chlorogallium phthalocyanine. The precursor chlorogallium phthalocyanine is prepared by reaction of o-cyanobenzamide with gallium chloride in the absence of solvent. O-cyanobenzamide is heated to its melting point (172° C.), and to it is added gallium chloride at which time the temperature is increased to 210° C. for 15 minutes, and then cooled. The solid is recrystallized out of boiling chloronaphthalene to give purple crystals having carbon, hydrogen and chlorine analyses matching theoretical values for chlorogallium phthalocyanine. Dissolution in concentrated sulfuric acid, followed by reprecipitation in diluted aqueous ammonia, affords material having carbon, and hydrogen analyses matching theoretical values for hydroxygallium phthalocyanine.

There are illustrated in JPLO.221459 certain gallium phthalocyanines and which phthalocyanines have the following intense diffraction peaks at Bragg angles (2 theta+/−0.2°) in the X-ray diffraction spectrum,

1—6.7, 15.2, 20.5, 27.0

2—6.7, 13.7, 16.3, 20.9, 26.3 (hydroxygallium phthalocyanine Type I)

3—7.5, 9.5, 11.0, 13.5, 19.1, 20.3, 21.8, 25.8, 27.1, 33.0 (chlorogallium phthalocyanine Type I).

In the Proceedings of the 9th International Congress on Advances in Non-Impact Printing Technologies, Watanabe et al. describe unsuccessful attempts to prepare highly photosensitive polymorphic forms of substituted titanyl phthalocyanines. $F_4$—TiOPc, $Cl_4$—TiOPc, and $(NO_2)_4$TiOPc were all subjected to acid pasting and polymorphic conversion methods. Despite varying conditions for the conversion process, the highly sensitive Type IV polymorph was not observed, and apparently only when unsubstituted TiOPc was selected did the Type IV polymorph result.

Layered photoresponsive imaging members have been described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of certain perylene pigments as photoconductive substances is known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering,* Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a perylene pigment photogenerating component. Both of the aforementioned patents disclose an aryl amine component as a hole transport layer.

In U.S. Ser. No. 537,714, the disclosure of which is totally incorporated herein by reference, there are illustrated photoresponsive imaging members with photogenerating titanyl phthalocyanine layers prepared by vacuum deposition. It is indicated in this copending application that the imaging members comprised of the vacuum deposited titanyl phthalocyanines and aryl amine hole transporting compounds exhibit superior xerographic performance with low dark decay characteristics and high photosensitivity, particularly in comparison to several prior art imaging members prepared by solution coating or spray coating, reference for example U.S. Pat. No. 4,429,029 mentioned hereinbefore.

In U.S. Pat. No. 5,153,313, the disclosure of which is totally incorporated herein by reference, there is illustrated a process for the preparation of phthalocyanine composites which comprises adding a metal-free phthalocyanine, a metal phthalocyanine, a metalloxy phthalocyanine or mixtures thereof to a solution of trifluoroacetic acid and a monohaloalkane; adding to the resulting mixture a titanyl phthalocyanine; adding the resulting solution to a mixture that will enable precipitation of said composite; and recovering the phthalocyanine composite precipitated product.

In U.S. Pat. No. 5,166,339, the disclosure of which is totally incorporated herein by reference, there is illustrated a process for the preparation of titanyl phthalocyanine which comprises the reaction of titanium tetrapropoxide with diiminoisoindolene in N-methylpyrrolidone solvent to provide Type I, or β-type titanyl phthalocyanine as determined by X-ray powder diffraction analysis; dissolving the resulting titanyl phthalocyanine in a mixture of trifluoroacetic acid and methylene chloride; adding the resulting mixture to a stirred organic solvent, such as methanol, or to water; separating the resulting precipitate by, for example, vacuum filtration through a glass fiber paper in a Buchner funnel; and washing the titanyl phthalocyanine product.

Disclosed in U.S. Pat. No. 5,164,493 is a process for the preparation of titanyl phthalocyanine Type I which comprises the addition of titanium tetraalkoxide in a solvent to a mixture of phthalonitrile and a diiminoisoindolene, followed by heating. The disclosure of this application is totally incorporated herein by reference. Disclosed in U.S. Pat. No. 5,189,156 is a process for the preparation of titanyl phthalocyanine Type I which comprises the reaction of titanium tetraalkoxide and diiminoisoindolene in the presence of a halonaphthalene solvent; and in U.S. Pat. No. 5,206,359 is a process for the preparation of titanyl phthalocyanine which comprises the treatment of titanyl phthalocyanine Type X with a halobenzene, the disclosures of which are totally incorporated herein by reference.

Illustrated in U.S. Pat. No. 5,382,493, the disclosure of which is totally incorporated herein by reference, are processes for the preparation of Type II dihydroxygermanium phthalocyanine, which comprises the reaction of phthalonitrile or diiminoisoindolene with tetrahalogermanium or tetraalkoxygermanium in a suitable solvent.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent such as N-methylpyrrolidone, present in an amount of from about 10 parts to about 100 parts, and preferably about 19 parts, with 1,3-diiminoisoindolene ($Dl^3$), in an amount of from about 1 part to about 10 parts, and preferably about 4 parts $Dl^3$, for each part of gallium chloride that is reacted; hydrolyzing the resulting pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example, from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling said Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours such that there is obtained a hydroxygallium phthalocyanine Type V, ball milling contains very low levels of residual chlorine of from about 0.001 percent to about 0.1 percent, and in an embodiment about 0.03 percent of the weight of the Type V hydroxygallium pigment, as determined by elemental analysis.

Also, processes for the preparation of hydroxygallium phthalocyanines are illustrated in copending patent applications U.S. Ser. No. 413,554, and U.S. Pat. Nos. 5,482,811; 5,466,796; 5,521,306; 5,493,106 and 5,456,998, the disclosures of each being totally incorporated herein by reference.

In U.S. Pat. No. 5,534,376, filed concurrently herewith and the disclosure of which is totally incorporated herein by reference, there is illustrated a photoconductive imaging member comprised of a supporting substrate, a photogenerating layer, and a charge transport layer, and wherein said photogenerating layer is comprised a tetrafluoro hydroxygallium phthalocyanine.

The disclosures of all of the aforementioned publications, laid open applications, copending applications and patents are totally incorporated herein by reference.

BRIEF DESCRIPTION OF THE FIGURES

There are illustrated in FIGS. 1 to 6 XRPDs for tetrafluoro hydroxygallium phthalocyanines with major and minor peaks as follows.

SUMMARY OF THE INVENTION

Figure 1:
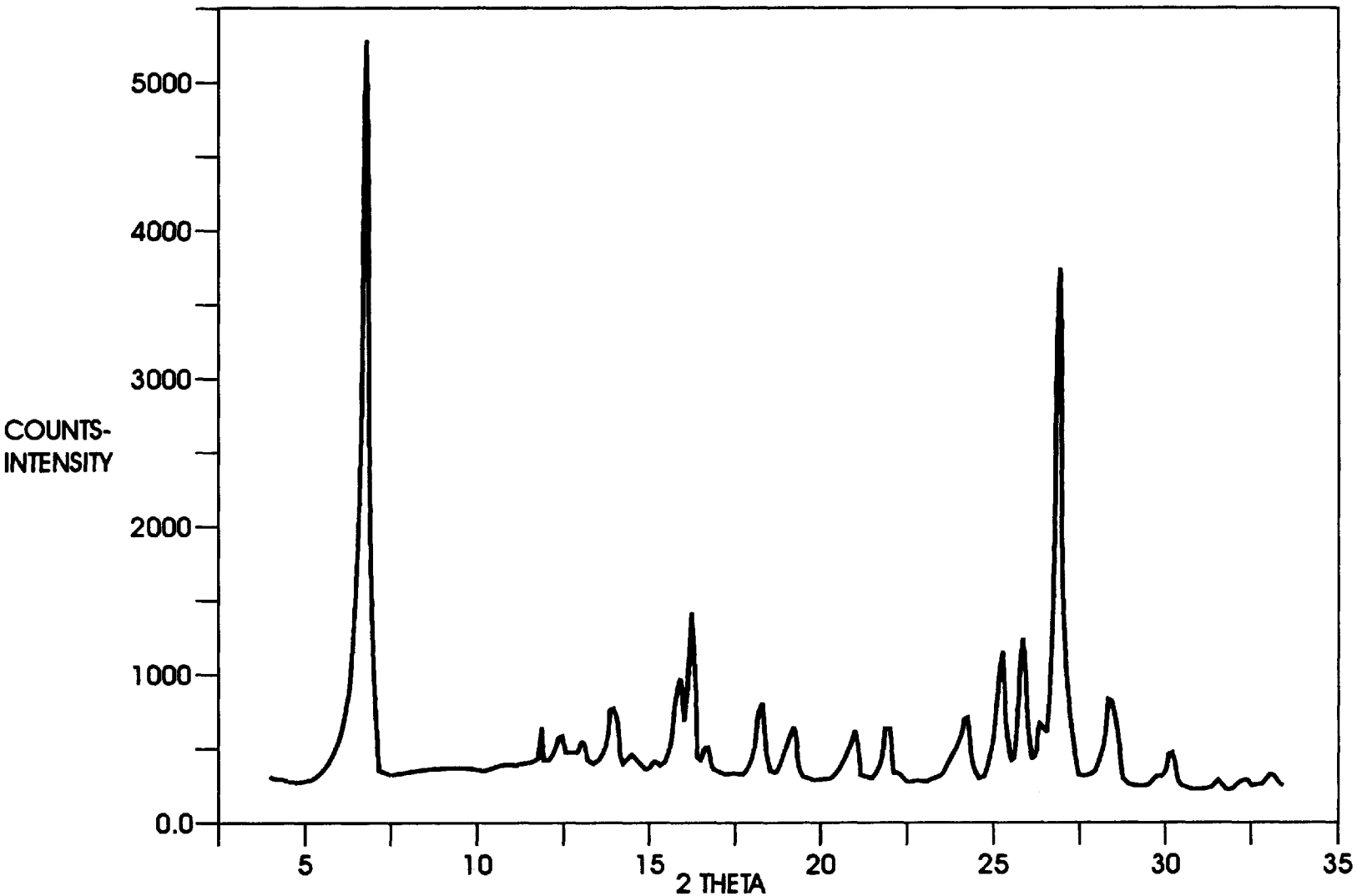
FIG. 1 illustrates a novel Type I tetrafluoro chlorogallium phthalocyanine with an X-Ray Diffraction Pattern having peaks at 16.5, 25.5, 26.2, 27.3, and 28.8, and the highest peak at 7.0 degrees 2Θ.

Examples of objects of embodiments of the present invention include the following.

It is an object of the present invention to provide tetrafluoro hydroxygallium phthalocyanines, processes thereof, and imaging members thereof with many of the advantages illustrated herein.

Another object of the present invention relates to the provision of improved layered photoresponsive imaging members with photosensitivity to near infrared radiations.

It is yet another object of the present invention to provide simple and economical processes for the preparation of Type I, Type II, Type III, Type IV, and Type V tetrafluoro hydroxygallium phthalocyanines.

In a further object of the present invention there are provided certain novel Type I, Type II, Type III, Type IV, and Type V tetrafluoro hydroxygallium phthalocyanines, and photoconductive imaging members thereof; and wherein the type obtained is determined by XRPD and is dependent, for example, on solvent selected.

In a further object of the present invention there are provided layered photoconductive members with excellent photosensitivity, and which members contain Type V tetrafluoro hydroxygallium phthalocyanine.

A further object of the present invention is the provision of mixtures of hydroxygallium phthalocyanine, especially Type V, and tetrafluoro hydroxy gallium phthalocyanines, especially Type V, processes thereof, and photoconductive imaging members thereof.

A further object of the present invention relates to the preparation of electrically pure Type V tetrafluoro hydroxygallium phthalocyanine in acceptable yield, exceeding 65 percent, and, for example, from about 40 percent to about 75 percent.

In still a further object of the present invention there are provided photoresponsive imaging members with an aryl amine hole transport layer, and a photogenerator layer comprised of Type V tetrafluoro hydroxygallium phthalocyanine pigment components obtained by the processes illustrated herein.

In another object of the present invention there are provided mixtures of substituted phthalocyanines, such as Type I, Type II, Type III, Type IV, and Type V tetrafluoro hydroxygallium phthalocyanines, and hydroxygallium phthalocyanines, processes thereof, and photoconductive imaging members thereof. In embodiments, the mixtures contain various effective amounts of each of the aforementioned components, such as from about 1 to about 99, and preferably from about 40 to about 70 weight percent of the substituted phthalocyanines, and from about 1 to about 99, and preferably from about 30 to about 60 weight percent of an unsubstituted hydroxygallium phthalocyanine, especially Type V.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value, $V_o$, of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})V_{ddp}$. The desired wavelength and energy of the exposed light was determined by the type of filters placed in front of the lamp. The monochromatic light photosensitivity was determined using a narrow band-pass filter. The photosensitivity of the imaging members is usually provided in terms of the amount of exposure energy in ergs/cm$^2$, designated as $E_{1/2}$, required to achieve 50 percent photodischarge from the dark development potential. The higher the photosensitivity, the smaller is the $E_{1/2}$ value.

These and other objects of the present invention can be accomplished in embodiments thereof by the provision of tetrafluoro hydroxygallium phthalocyanines, processes thereof, and photoconductive imaging members thereof, and wherein in embodiments the phthalocyanines are as illustrated in FIGS. 1 to 5. Also, in embodiments there are provided mixtures of hydroxyphthalocyanines and tetrafluoro hydroxygallium phthalocyanines, and photoconductive imaging members thereof. Preferred in embodiments of the present invention are tetrafluoro hydroxygallium phthalocyanine Type V, and mixtures thereof with hydroxygallium phthalocyanine Type V, for example, from about 1 to about 99, and preferably from about 40 to about 70 weight percent of the substituted phthalocyanines, and from about 1 to about 99, and preferably from about 30 to about 60 weight percent of an unsubstituted hydroxygallium phthalocyanine, especially Type V.

The process of the present invention in embodiments comprises the generation of tetrafluoro-halo, especially tetrafluoro chlorogallium phthalocyanine by the reaction of a fluorophthalonitrile with a gallium halide, especially gallium chloride, in a solvent such as a halo, especially chloronaphthalene, followed by the hydrolysis or acid pasting thereof to provide a tetrafluoro hydroxygallium phthalocyanine Type I, and subsequently mixing, for example by ball milling, in the presence of a solvent, for example N,N-dimethylformamide, dimethylaminoethanol, isopropanol, or N-methylpyrrolidone, for effective periods of time to provide Type I to Type V tetrafluoro hydroxygallium phthalocyanines.

Embodiments of the present invention are directed to processes for the preparation of tetrafluoro hydroxygallium phthalocyanine Type V, which comprises the reaction of 1 weight part of gallium chloride with from about 1 weight part to about 10 weight parts, and preferably about 4 weight parts of 4-fluorophthalonitrile in a solvent, such as quinoline, a halonaphthalene like chloronaphthalene, or N-methylpyrrolidone in an amount of from about 5 weight parts to about 100 weight parts, and preferably about 15 weight parts, for each weight part of gallium chloride that is used, to provide a pigment precursor tetrafluoro chlorogallium phthalocyanine, which is subsequently washed with a component, such as dimethylformamide, to provide a pure, 95 to 99.9 percent pure, form of the precursor Type I tetrafluoro chlorogallium phthalocyanine as determined by X-ray powder diffraction; dissolving 1 weight part of the resulting tetrafluoro chlorogallium phthalocyanine pigment in concentrated, about 94 percent, sulfuric acid in an amount of from about 1 weight part to about 100 weight parts and in an embodiment about 25 weight parts by stirring the pigment in the acid for an effective period of time, for example from about 30 seconds to about 24 hours, and in an embodiment about 2 hours at a temperature of from about −5° C. to about 25° C., and preferably about 0° C. in air or under an inert atmosphere such as argon or nitrogen; adding the resulting mixture to a stirred organic solvent, for example aqueous ammonia, in a dropwise manner at a rate of about 0.5 milliliter per minute to about 10 milliliters per minute and in an embodiment about 1 milliliter per minute to a nonsolvent, such as a mixture comprised of from about 1 volume part to about 10 volume parts and preferably about 4 volume parts of concentrated aqueous ammonia solution (14.8 N) and from about 1 volume part to about 10 volume parts, and preferably about 6 volume parts of water for each volume part of sulfuric acid that was used, or a nonsolvent aqueous solution of sodium hydroxide, potassium hydroxide, methanol, or ethanol, which nonsolvent mixture was chilled to a temperature of from about −25° C. to about 10° C. and in an embodiment about −5° C. while being stirred at a rate sufficient to create a vortex extending to the bottom of the flask containing the solvent mixture; isolating the resulting blue pigment by, for example, filtration; and washing the resulting tetrafluoro hydroxygallium phthalocyanine product obtained with deionized water by redispersing and filtering from portions of deionized water, which portions are from about 10 volume parts to about 400 volume parts and in an embodiment about 200 volume parts for each weight part of precursor pigment tetrafluoro chlorogallium phthalocyanine which was used. The product, a dark blue solid, was confirmed to be Type I tetrafluoro hydroxygallium phthalocyanine on the basis of its X-ray diffraction pattern having major peaks at 15.6 and 26.5, and the highest peak at 6.5 degrees 2Θ. The Type I tetrafluoro hydroxygallium phthalocyanine product obtained can then be treated with a solvent, such as N,N-dimethylformamide, N-methylpyrrolidone, isopropanol, by, for example, ball milling the Type I tetrafluoro hydroxygallium phthalocyanine pigment in the presence of spherical glass beads, approximately 1 millimeter to 5 millimeters in diameter, at room temperature, about 25° C., for a period of from about 12 hours to about 2 weeks, and preferably about 1 week such that there is obtained a tetrafluoro hydroxygallium phthalocyanine Type V in a purity of up to about 95 to 99.5 percent.

For the preparation of the precursor tetrafluoro chlorogallium phthalocyanine, the process in embodiments comprises the reaction of 1 weight part of gallium chloride with from about 1 weight part to about 10 weight parts and preferably about 4 weight parts of 4-fluorophthalonitrile in the presence of 1-chloronaphthalene solvent in an amount of from about 5 weight parts to about 100 weight parts and preferably about 15 weight parts, whereby there is obtained a crude tetrafluoro chlorogallium phthalocyanine, which is subsequently purified, up to about a 99.5 percent purity, by washing with, for example, hot dimethylformamide at a temperature of from about 70° C. to about 150° C., and preferably about 150° C. in an amount of from about 1 to about 10, and preferably about 3 times the volume of the solid precursor pigment being washed.

In embodiments, the process of the present invention comprises 1) the addition of 1 part gallium chloride to a stirred solvent, 1-chloronaphthalene, present in an amount of from about 5 parts to about 100 parts, and preferably about 15 parts; 2) relatively slow application of heat using an appropriate sized heating mantle at a heating rate of about 1 degree per minute to about 10 degrees per minute, and preferably about 5 degrees per minute until a temperature of about 200° C. is reached; 3) continued stirring at this temperature for a period of about ½ hour to about 8 hours and preferably about 4 hours; 4) cooling the reactants to a temperature of about 130° C. to about 180° C. and preferably about 160° C. by removal of the heat source; 5) filtration of the flask contents through, for example, an M-porosity (10 to 15 μm) sintered glass funnel, which was preheated using a solvent, which is capable of raising the temperature of the funnel to about 150° C., for example, boiling N,N-dimethylformamide in an amount sufficient to completely cover the bottom of the filter funnel so as to prevent blockage of the funnel; 6) washing the resulting purple solid by slurrying this solid in portions of boiling DMF either in the funnel or in a separate vessel in a ratio of about 1 to about 10, and preferably about 3 times the volume of the solid being washed until the hot filtrate became light blue in color; 7) cooling and further washing the solid of impurities by slurrying the solid in portions of N,N-dimethylformamide at room temperature, about 25° C., approximately equivalent to about three (3) times the volume of the solid being washed until the filtrate became light blue in color; 8) washing the solid of impurities by slurrying the solid in portions of an organic solvent, such as methanol, acetone, and the like, water, and the like, and in an embodiment methanol at room temperature, about 25° C., approximately equivalent to about three times the volume of the solid being washed until the filtrate became light blue in color; and 9) oven drying the purple solid in the presence of a vacuum or in air at a temperature of from about 25° C. to about 200° C. and preferably about 50° C. for a period of from about 2 hours to about 48 hours and preferably about 24 hours thereby resulting in the isolation of a blue solid in an acceptable yield, in an embodiment about 40 percent, of tetrafluoro chlorogallium phthalocyanine having an X-ray powder diffraction trace with major peaks at 9.6, 15.2, 20.9, 26.7, and 28.1 and the highest peak at 6.9 degrees 2Θ. The obtained precursor pigment tetrafluoro chlorogallium phthalocyanine can then be hydrolyzed by 1) dissolving 1 weight part of the resulting tetrafluoro chlorogallium phthalocyanine pigment in concentrated, about 94 percent, sulfuric acid in an amount of from about 1 weight part to about 100 weight parts and in an embodiment about 25 weight parts; 2) stirring the pigment in the acid for an effective period of time, from about 30 seconds to about 24 hours, and in an embodiment about 2 hours at a temperature of from about −5° C. to about 25° C., and preferably about 0° C., in air or under an inert atmosphere such as argon or nitrogen; 3) adding the resulting mixture to a stirred organic solvent, such as aqueous ammonia, or an aqueous solution of sodium hydroxide, potassium hydroxide, methanol, or ethanol in a dropwise manner at a rate of about 0.5 milliliter per minute to about 10 milliliters per minute and in an embodiment about 1 milliliter per minute to a nonsolvent, which nonsolvent can be comprised of a mixture with from about 1 volume part to about 10 volume parts and preferably about 4 volume parts of concentrated aqueous ammonia solution (14.8 N) and from about 1 volume part to about 10 volume parts, and preferably about 6 volume parts of water for each volume part of sulfuric acid that was used, which nonsolvent mixture was chilled to a temperature of from about −25° C. to about 10° C. and in an embodiment about −5° C. while being stirred at a rate sufficient to create a vortex extending to the bottom of the flask containing the solvent mixture; 4) isolating the resulting blue pigment by, for example, filtration; 5) washing the resulting Type I tetrafluoro hydroxygallium phthalocyanine product obtained with deionized water by redispersing and filtering from portions of deionized water, which portions are from about 10 volume parts to about 400 volume parts and in an embodiment about 200 volume parts for each weight part of precursor pigment tetrafluoro chlorogallium phthalocyanine which was used; and 6) drying the resulting filter cake in an oven at a temperature of from about 40° C. to about 100° C. and in an embodiment about 50° C. resulting in the isolation of a blue solid in an acceptable yield, for example greater than 90 percent, and more specifically about 95 percent of Type I tetrafluoro hydroxygallium phthalocyanine having an X-ray diffraction pattern with major peaks at 15.6 and 26.5, and the highest peak at 6.5 degrees 2Θ.

The Type I tetrafluoro hydroxygallium phthalocyanine product obtained can then be converted to more photosensitive polymorphic forms by 1) the addition of 1 weight part of the intermediate pigment Type I tetrafluoro hydroxygallium phthalocyanine to a solvent, such as N-methylpyrrolidone, present in an amount of from about 5 weight parts to about 25 weight parts and in an embodiment 15 weight parts, and spherical glass beads, approximately 1 millimeter to 10 millimeters in diameter, and in an embodiment 1 millimeter in a sealed glass bottle; 2) ball milling at room temperature, about 25° C., for a period of from about 12 hours to about 2 weeks, and in an embodiment about 1 week; 3) filtering the resulting pigment dispersion using a Buchner filter funnel fitted with a Whatman GF/F grade glass fiber filter cloth; 4) washing the pigment with a solvent, such as acetone, methanol, or the like, in an amount of from about 10 volume parts to about 100 volume parts, and in an embodiment about 50 volume parts for each weight part of pigment Type I tetrafluoro hydroxygallium phthalocyanine that was used; and 5) drying the resulting filter cake in an oven at a temperature of from about 40° C. to about 100° C. and in an embodiment about 50° C., resulting in the isolation of a blue solid in an acceptable yield, for example greater than 90 percent, and more specifically, 95 percent of Type V tetrafluoro hydroxygallium phthalocyanine in a purity of up to about 99.5 percent, and more specifically, 98 percent having an X-ray diffraction pattern with peaks at 6.0, 13.4, 14.7, 15.9, 16.9, 26.1, and 27.0, and the highest peak at 6.6 degrees 2Θ.

The tetrafluoro hydroxygallium phthalocyanines of the present invention are illustrated with reference to the following chemical formulas and wherein for each form, like Type V, the crystal structure (or packing) changes, or is dissimilar.

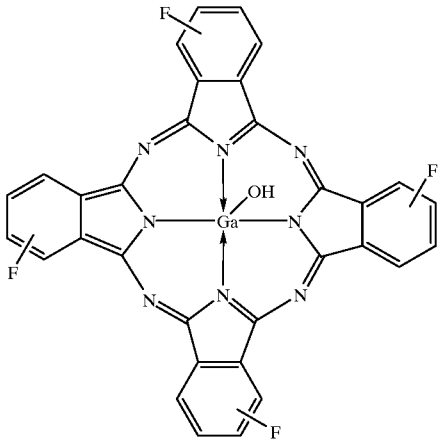

The tetrafluoro hydroxygallium phthalocyanines of the present invention can also be combined or admixed with other pigments, and in particular, Type V hydroxygallium phthalocyanine, having a chemical structure very similar to the aforementioned tetrafluoro hydroxygallium phthalocyanine. The aforementioned mixtures provide the advantage of preparing a photoreceptor with a range of photosensitivities, of from about 100 $V \cdot cm^2$/erg to about 300 $V \cdot cm^2$/erg, while maintaining a desirable degree of dark decay of, for example, from about 5 to about 15 volts/second and residual voltages of, for example, from about 0 volts to about 20 volts. Mixtures of tetrafluoro hydroxygallium phthalocyanines and hydroxygallium phthalocyanines can be prepared in differing amounts of, for example, zero percent Type V tetrafluoro hydroxygallium phthalocyanine and one hundred percent Type V hydroxygallium phthalocyanine; fifty percent Type V tetrafluoro hydroxygallium phthalocyanine and fifty percent Type V hydroxygallium phthalocyanine; one hundred percent Type V tetrafluoro hydroxygallium phthalocyanine and zero percent Type V hydroxygallium phthalocyanine, and all ratios between, such that there can be obtained photoreceptor devices having a range of photosensitivities as described above and shown in Table 2.

The mixtures can be prepared by combining the two dry pigments, Type V tetrafluoro hydroxygallium phthalocyanine and Type V hydroxygallium phthalocyanine, in the desired ratio, for example fifty percent Type V tetrafluoro hydroxygallium phthalocyanine and fifty percent Type V hydroxygallium phthalocyanine, in a sealed bottle, and effecting mixing by, for example, ball milling at room temperature, about 25° C., for a period of not less than about 1 hour, and in embodiments from about 1 to about 10 hours.

Numerous different layered photoresponsive imaging members with the tetrafluoro hydroxygallium phthalocyanine pigments, especially Type V, obtained by the processes of the present invention can be fabricated. In embodiments, thus the layered photoresponsive imaging members are comprised of a supporting substrate, a blocking layer, a charge transport layer, especially an aryl amine hole transport layer, and situated therebetween a photogenerator layer comprised of the Type I to Type V illustrated herein, and mixtures thereof with hydroxygallium tetrafluoro hydroxygallium phthalocyanine photogenerating pigments. Another embodiment of the present invention is directed to positively charged layered photoresponsive imaging members comprised of a supporting substrate, a blocking layer, a charge transport layer, especially an aryl amine hole transport layer, and as a top overcoating layer Type V tetrafluoro hydroxygallium phthalocyanine pigment obtained with the processes of the present invention. Moreover, there is provided in accordance with the present invention an improved negatively charged photoresponsive imaging member comprised of a supporting substrate, a thin adhesive layer, Type V tetrafluoro hydroxygallium phthalocyanine photogenerator obtained by the processes of the present invention dispersed in a polymeric resinous binder, such as poly(vinyl butyral), and as a top layer aryl amine hole transporting molecules dispersed in a polymeric resinous binder such as polycarbonate.

The photoresponsive, or photoconductive imaging members of the present invention can be prepared by a number of known methods, the process parameters and the order of coating of the layers being dependent on the member desired. The imaging members suitable for positive charging can be prepared by reversing the order of deposition of the photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, and the like, and dried at from 40 to about 200° C. for from 10 minutes to several hours under stationary conditions or in an air flow. The coating is accomplished to provide a final coating thickness of from 0.01 to about 30 microns after it has dried. The fabrication conditions for a given layer can be tailored to achieve optimum performance and cost in the final device.

Imaging members of the present invention are useful in various electrostatographic imaging and printing systems, particularly those conventionally known as xerographic processes. Specifically, the imaging members of the present invention are useful in xerographic imaging processes wherein Type I tetrafluoro hydroxygallium phthalocyanine pigment absorbs light of a wavelength of from about 500 to about 900 nanometers, and preferably from about 600 to about 850, with major peaks at 628, 708, and 792 nanometers; Type II tetrafluoro hydroxygallium phthalocyanine pigment absorbs light of a wavelength of from about 500 to about 900 nanometers, and preferably from about 600 to about 850, with major peaks at 634, 716, and 789 nanometers; Type III tetrafluoro hydroxygallium phthalocyanine pigment absorbs light of a wavelength of from about 500 to about 900 nanometers, and preferably from about 600 to about 850, with major peaks at 623, and 790 nanometers; Type IV tetrafluoro hydroxygallium phthalocyanine pigment absorbs light of a wavelength of from about 500 to about 900 nanometers, and preferably from about 600 to about 850, with major peaks at 622 and 696 nanometers; Type V tetrafluoro hydroxygallium phthalocyanine pigment absorbs light of a wavelength of from about 500 to about 900 nanometers, and preferably from about 600 to about 850, with major peaks at 631 and 799 nanometers. In these known processes, electrostatic latent images are initially formed on the imaging member followed by development with a toner of resin like styrene methacrylate, styrene acrylate, styrene butadiene, a polyester, and pigment like carbon black, thereafter transferring the image to a suitable substrate and fixing thereto. Imaging members employing Type V tetrafluoro hydroxygallium phthalocyanine photogenerator pigment of the present invention exhibit high photosensitivities, generally with $E_{1/2}$ of about 5.0 ergs/cm$^2$ or less, even when exposed to monochromatic radiation of about 700 to 800 nanometers.

Moreover, the imaging members of the present invention can be selected for electronic printing processes with gallium arsenide light emitting diode (LED) arrays which typically function at wavelengths of from 660 to about 830 nanometers.

One negatively charged photoresponsive imaging member of the present invention is comprised, in the order indicated, of a supporting substrate, an adhesive layer comprised, for example, of the polyester 49,000 available from Goodyear Chemical, a photogenerator layer comprised of Type V tetrafluoro hydroxygallium phthalocyanine obtained with the process of the present invention, optionally dispersed in an inactive polymer binder, and a hole transport layer thereover comprised of N,N'-diphenyl-N,N'-bis(3-methyl phenyl)-1,1'-biphenyl-4,4'-diamine dispersed in a polycarbonate binder; and a positively charged photoresponsive imaging member comprised of a substrate, thereover a charge transport layer comprised of N,N'-diphenyl-N,N'-bis(3-methyl phenyl)-1,1'-biphenyl-4,4'-diamine dispersed in a polycarbonate binder, and a top photogenerator layer comprised of Type V tetrafluoro hydroxygallium phthalocyanine obtained with the process of the present invention optionally dispersed in an inactive polymer binder.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In one embodiment, the thickness of this layer is from about 75 microns to about 300 microns.

With further regard to the imaging members, the photogenerator layer is preferably comprised of Type V tetrafluoro hydroxygallium phthalocyanine obtained with the processes of the present invention dispersed in polymer binders. Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the dihydroxygermanium phthalocyanine photogenerator composition is present in an amount of from about 5 percent to about 100 percent by volume. in one embodiment, this layer is of a thickness of from about 0.25 micron to about 1 micron when the photogenerator composition is present in this layer in an amount of 30 to 75 percent by volume. The maximum thickness of this layer in an embodiment is dependent primarily upon factors, such as photosensitivity, electrical properties and mechanical considerations. The photogenerator layer can be fabricated by coating a dispersion of Type V hydroxygallium phthalocyanine obtained with the processes of the present invention in a suitable solvent with or without an optional polymer binder material. The dispersion can be prepared by mixing and/or milling the Type V in equipment such as paint shakers, ball mills, sand mills and attritors. Common grinding media such as glass beads, steel balls or ceramic beads may be used in this equipment. The binder resin present, for example, in an amount of from about 10 weight percent to about 70 weight percent and preferably about 35 weight percent (based on the total weight percent of photogenerating pigment and binder) may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not disturb or adversely affect the other previously coated layers of the device. Examples of solvents that can be selected for use as coating solvents for the photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate, methoxyethyl acetate, and the like.

The coating of the photogenerator layer in embodiments of the present invention can be accomplished with spray, dip or wire-bar methods such that the final dry thickness of the photogenerator layer is from 0.01 to 30 microns and preferably from 0.1 to 15 microns after being dried at 40 to 150° C. for 5 to 90 minutes.

Illustrative examples of polymeric binder materials that can be selected for the photogenerator pigment include those polymers as disclosed in U.S. Pat. No. 3,121,006, the disclosure of which is totally incorporated herein by reference.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of from about 0.001 micron to about 1 micron. Optionally, this layer may contain conductive and nonconductive particles, such as zinc oxide, titanium dioxide, silicon nitride, carbon black, and the like, to provide, for example, in embodiments of the present invention desirable electrical and optical properties.

Aryl amines selected for the charge, especially hole transporting layer, which generally is of a thickness of from about 5 microns to about 75 microns, and preferably of a thickness of from about 10 microns to about 40 microns, include molecules of the following formula

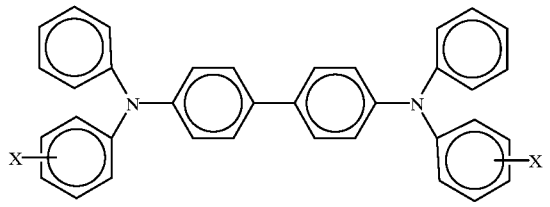

dispersed in a highly insulating and transparent polymer binder, wherein X is an alkyl group or a halogen, especially those substituents selected from the group consisting of Cl and $CH_3$. Other charge transport components may be selected in embodiments, such as hydrazones.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder material for the transport layers include materials such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples are also provided.

EXAMPLE I

Synthesis of the Precursor—Tetrafluoro Chlorogallium Phthalocyanine

A 500 milliliter three-necked flask fitted with mechanical stirrer, condenser and thermometer maintained under an atmosphere of argon was charged with 4-fluorophthalonitrile (49.5 grams—0.338 mole), gallium chloride (14.9 grams—0.0846 mole; Aldrich Chemical) and 200 milliliters of 1-chloronaphthalene, which had been dried over molecular sieves. The mixture was heated and stirred at 200° C. for 2 hours. The product was cooled to ~150° C., and filtered through a 150 milliliter M-porosity sintered glass funnel which was preheated to approximately 150° C. with boiling DMF, and then washed thoroughly with three portions of 100 milliliters of boiling DMF, (N,N-dimethylformamide) followed by three portions of 100 milliliters of DMF at room temperature, and then three portions of 50 milliliters of methanol, thus providing 23.2 grams (40 percent yield) of a blue powder. A typical X-ray diffraction pattern for this intermediate is shown in FIG. 1.

EXAMPLE II

Hydrolysis of the Precursor

Figure 2:
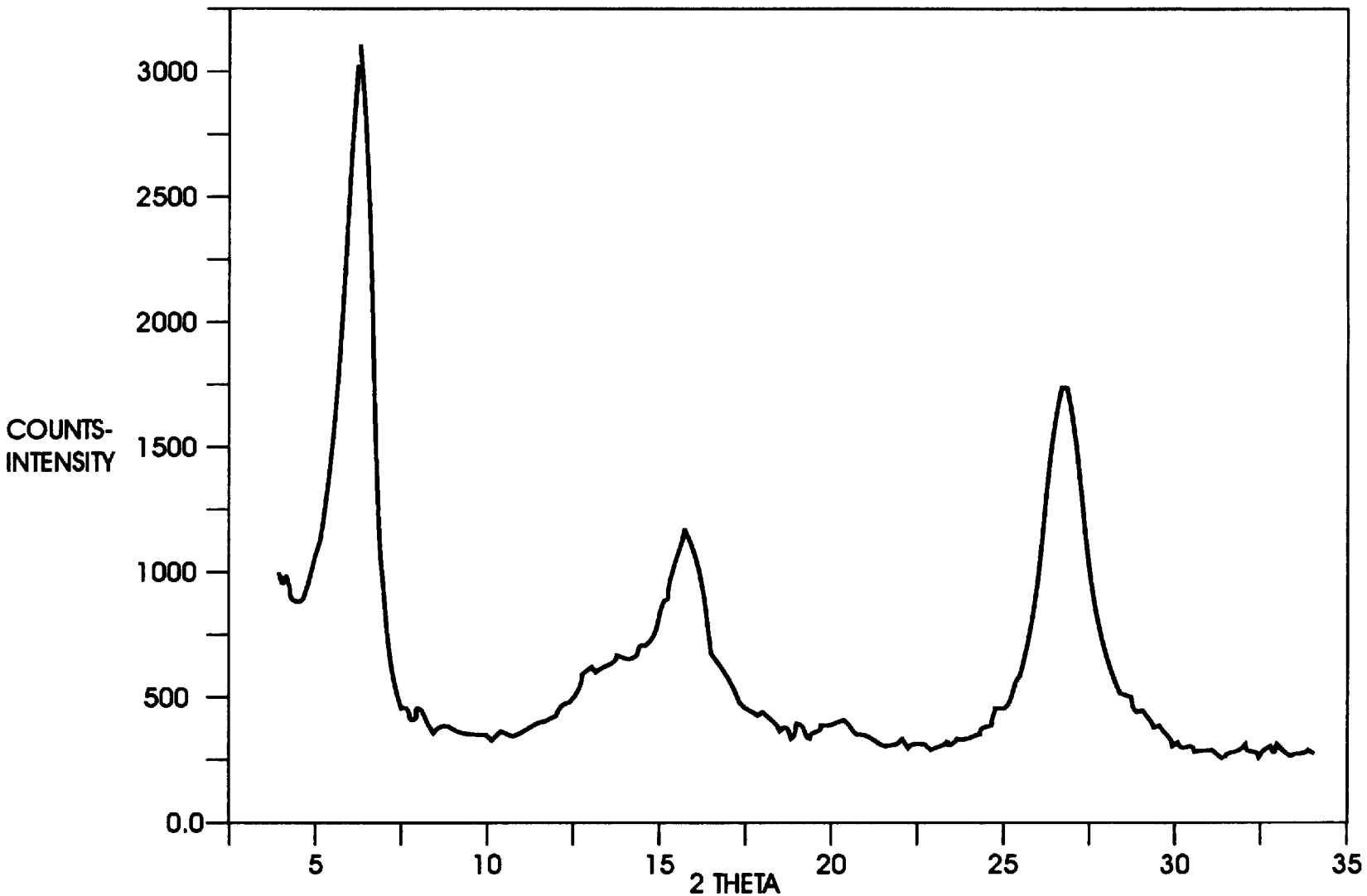
FIG. 2 illustrates a novel Type I tetrafluoro hydroxygallium phthalocyanine with an X-Ray Diffraction Pattern having a major peak at 6.5, and minor peaks at 15.6, and 26.5 degrees 2Θ.

Sulfuric acid (125 grams) was cooled to 0° C. in a 125 milliliter Erlenmeyer flask. To the cold acid were added 5 grams of the blue solid pigment precursor prepared as described above. The addition of the solid was completed in approximately 15 minutes, during which time the temperature of the solution increased to about 10 to 15° C. The resulting acid solution was then stirred for 2 hours at 0° C., at which time it was added in a dropwise fashion to a mixture comprised of concentrated (~33 percent) ammonia (265 milliliters) and deionized water (435 milliliters), which had been cooled to a temperature below 5° C. Addition of the dissolved pigment was completed in approximately 45 minutes, during which time the temperature of the solution increased to about 20° C. The resulting reprecipitated pigment was then removed from the cooling bath, and allowed to stir at room temperature for 1 hour. It was then filtered through a porcelain funnel fitted with a Whatman 934-AH grade glass fiber filter. The resulting blue pigment was redispersed in fresh deionized water by stirring at room temperature for 1 hour, and filtered as before. This process was repeated at least three times, until the conductivity of the filtrate was <20 $\mu$S. The resulting filter cake was oven dried overnight at 50° C. to provide 4.75 grams (95 percent) of a dark blue solid, Type I tetrafluoro hydroxygallium phthalocyanine. A typical X-ray diffraction pattern for this intermediate pigment is shown in FIG. 2.

EXAMPLE III

Conversion to New Polymorphs

Figure 3:
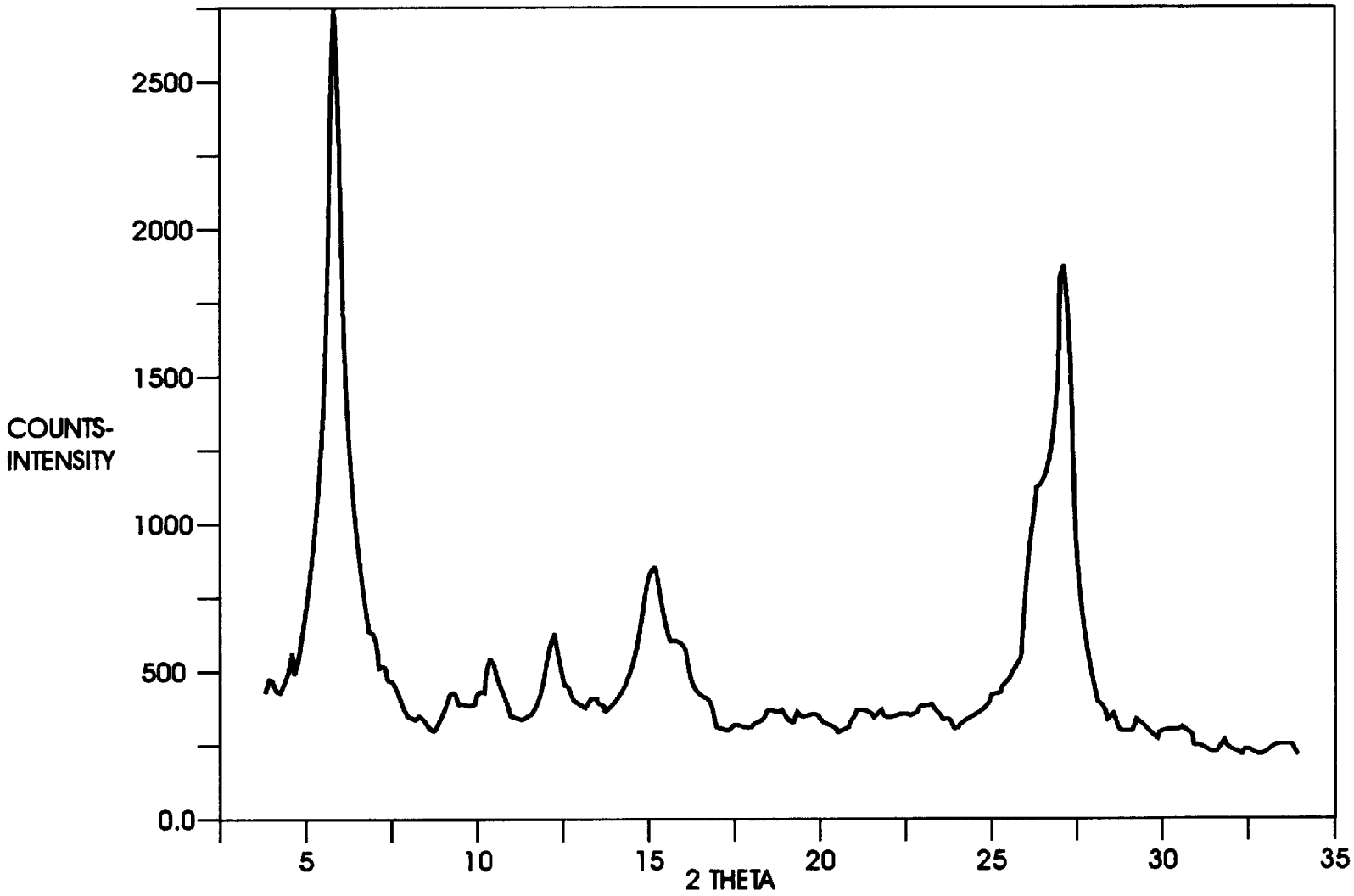
FIG. 3 illustrates a novel Type II tetrafluoro hydroxygallium phthalocyanine with an X-Ray Diffraction Pattern having a major peak at 6.6, and minor peaks at 12.7, 15.4, 26.3, and 27.0 degrees 2Θ.

The intermediate pigment prepared in Example III (3.0 grams) was added to 45 milliliters of N,N-dimethylformamide (see Table 1) in a 120 milliliter glass bottle containing 90 grams of glass beads (1 millimeter diameter). The bottle was sealed and placed on a ball mill for one week. The solid was isolated by filtration through a porcelain funnel fitted with a Whatman GF/F grade glass fiber filter, and washed in the filter using five portions of acetone (50 milliliters) (BDH Assured). The filter cake was oven dried overnight at 50° C. to provide 2.8 grams (93 percent) of a dark blue solid, Type II tetrafluoro hydroxygallium phthalocyanine. X-ray diffraction patterns for the resulting polymorph are shown in FIG. 3.

EXAMPLE IV

Figure 4:
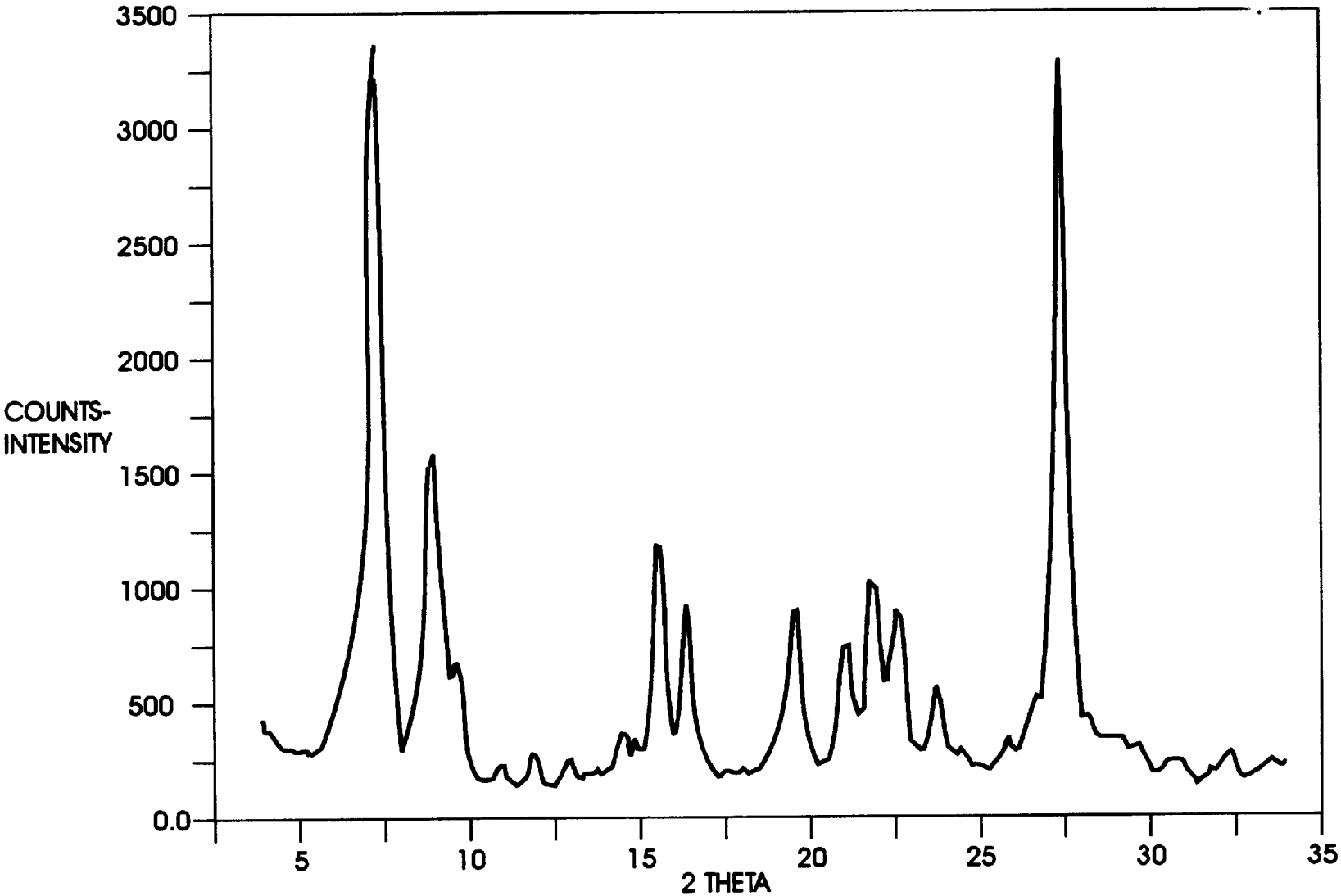
FIG. 4 illustrates a novel Type III tetrafluoro hydroxygallium phthalocyanine with an X-Ray Diffraction Pattern having a major peak at 7.5, and minor peaks at 9.1, 15.6, 16.5, 19.5, 21.8, 22.6, and 27.3 degrees 2Θ.

The process of Example III above was repeated except that dimethylaminoethanol was selected as the solvent instead of N,N-dimethylformamide. The resulting product was Type III tetrafluoro hydroxygallium phthalocyanine. X-ray diffraction patterns for the resulting polymorph are shown in FIG. 4.

EXAMPLE V

Figure 5:
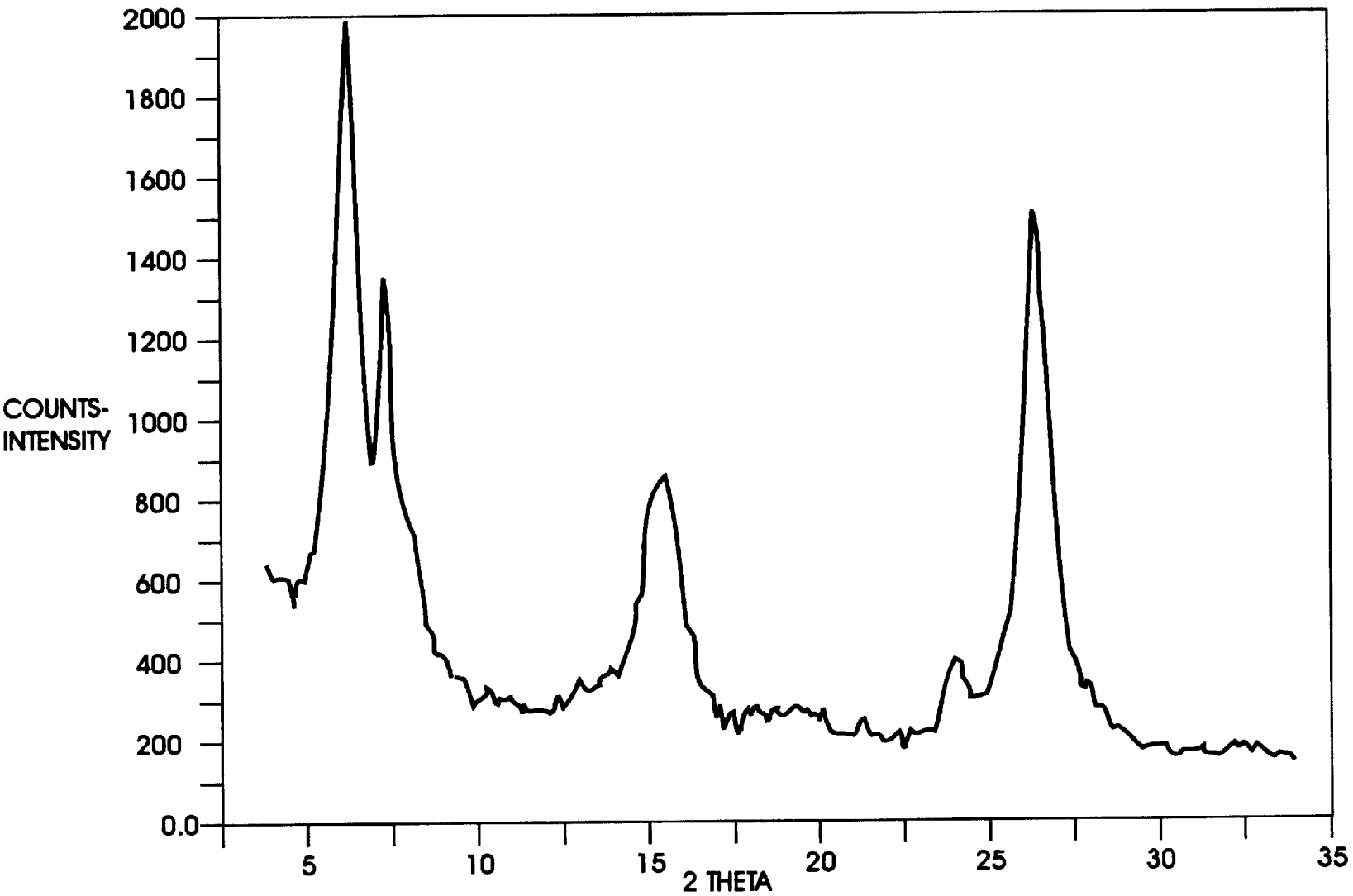
FIG. 5 illustrates a novel Type IV tetrafluoro hydroxygallium phthalocyanine with an X-Ray Diffraction Pattern having a major peak at 6.5, and minor peaks at 7.5, 15.2, 15.7, and 26.5 degrees 2Θ.

The process of Example III above was repeated except that isopropanol was selected as the solvent in place of N,N-dimethylformamide. The resulting product was Type IV tetrafluoro hydroxygallium phthalocyanine. X-ray diffraction patterns for the resulting polymorph are shown in FIG. 5.

EXAMPLE VI

Figure 6:
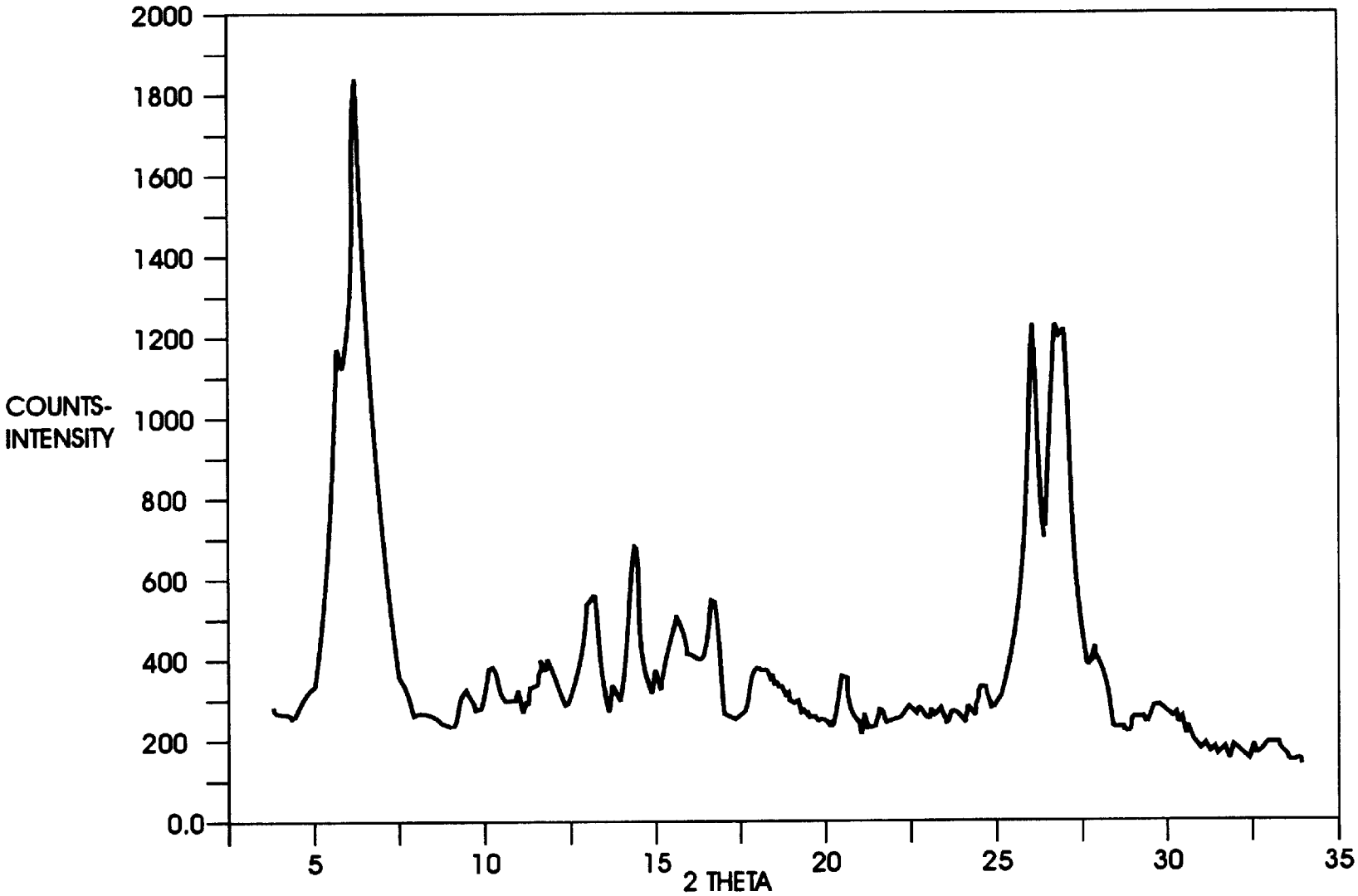
FIG. 6 illustrates a novel Type V tetrafluoro hydroxygallium phthalocyanine with an X-Ray Diffraction Pattern having a major peak at 6.6, and minor peaks at 6.0, 13.4, 14.7, 15.9, 16.9, 26.1, and 27.0 degrees 2Θ.

The process of Example III above was repeated except that N-methylpyrrolidone was selected as the solvent in place of N,N-dimethylformamide. The resulting product was Type V tetrafluoro hydroxygallium phthalocyanine. X-ray diffraction patterns for the resulting polymorph are shown in FIG. 6.

EXAMPLE VII

Unsubstituded Hydroxygallium Phthalocyanine

Synthesis of the Precursor—Alkoxy-bridged Gallium Phthalocyanine Dimer

A 20 gallon glass-lined reactor was purged with nitrogen and charged with 32 kilograms of toluene. The reactor agitator was started and 3.0 kilograms of gallium trichloride were loaded through the reactor loading port. The reactor loading port was closed and the agitator speed increased to 200 rpm, while cooling was applied to the reactor jacket. 11.04 Kilograms of sodium methoxide solution (25 weight percent in methanol) were charged to the reactor from an addition vessel over a period of 30 minutes. The reactor was then charged with 8.732 kilograms of o-phthalodinitrile and 20 kilograms of ethylene glycol. The reactor was then heated using hot oil supply to the reactor jacket. During heating to reaction temperature of 195 to 200° C., methanol and toluene were removed by distillation. After 20 kilograms of distillate had been removed, another 20 kilograms of ethylene glycol were charged into the reactor from the addition vessel over a period of 10 minutes. The reaction was carried out for 5 hours at 195 to 200° C. At the end of the 5 hour reaction period, cooling was applied. When the reactor temperature was 90° C., the reactor contents were discharged into an agitated vacuum filter and the filtrate drained. The crude material was reslurry washed two times with 50 kilograms of hot DMF used to rinse the reactor. The washing was carried out two more times with 100 kilograms of hot DMF at 75 to 90° C. The material was then reslurry washed three times with 50 kilograms of deionized water at 75 to 90° C. The wet cake was then reslurry washed three additional times for 30 minutes with 50 kilograms warm methanol (45° C.) and filtered. The material was dried at 60° C. in a vacuum shelf dryer. 8.51 Kilograms of the alkoxy-bridged galliumphthalocyanine dimer [(PcGaOCH)] were obtained (81.4 percent yield).

EXAMPLE VIII

Hydrolysis of the Precursor (Type I HOGaPc)

Sulfuric acid (125 grams) was heated to 40° C. in a 125 milliliters Erlenmeyer flask. To the heated acid were added 5 grams of the blue solid alkoxy-bridged gallium phthalocyanine dimer [(PcGaOCH)] prepared as described above. Addition of the solid was completed over the course of approximately 15 minutes, during which time the temperature of the solution increased to about 47 to 48° C. The acid solution was then stirred for 2 hours at 40° C., at which time it was added in a dropwise fashion to a mixture comprised of concentrated (~33 percent) ammonia (265 milliliters) and deionized water (435 milliliters), which had been cooled to a temperature below 5° C. Addition of the dissolved pigment was completed over the course of approximately 30 minutes, during which time the temperature of the solution increased to about 35 to 40° C. The reprecipitated pigment was then removed from the cooling bath, and allowed to stir at room temperature for 1 hour. It was then filtered through a porcelain funnel fitted with a Whatman 934-AH grade glass fiber filter. The resulting blue pigment was redispersed in fresh deionized water by stirring at room temperature for 1 hour, and filtered as before. This process was repeated at least three times until the conductivity of the filtrate was <20 $\mu$S. The filter cake was oven dried overnight at 50° C. to provide 4.75 grams (95 percent) of a dark blue solid Type I hydroxygallium phthalocyanine.

EXAMPLE IX

Conversion to Type V OHGaPc

The above (95 percent) dark blue solid Type I product pigment (3.0 grams) was added to 45 milliliters of N,N-dimethylformamide (BDH Assured) in a 120 milliliter glass bottle containing 90 grams of glass beads (1 millimeter diameter). The bottle was sealed and placed on a ball mill overnight (16 to 24 hours). The solid was isolated by filtration through a porcelain funnel fitted with a Whatman GF/F grade glass fiber filter, and washed in the filter using five portions of n-butyl acetate (50 milliliters) (BDH Assured). The filter cake was oven dried overnight, about 18 hours, at 50° C. to provide 2.8 grams (93 percent) of a dark blue solid, which was identified as Type V OHGaPc by XRPD.

EXAMPLE X

Preparation of Pigment Mixtures

Mixtures of Type V hydroxygallium phthalocyanine and Type V tetrafluoro hydroxygallium phthalocyanine were prepared by combining 50 percent of each of the two dried pigments in a glass bottle, and mixing by ball mill for 2 hours.

Device Fabrication

Devices, or photoconductive imaging members were tested under conditions of monochromatic light ($\lambda$=780 nanometers) exposure and $V_{ddp}$=800 volts, using the device configuration which follows:

Ti (Mylar)/~0.05 μm gamma-aminopropyl methyl diethoxysilane/~0.05 μm polyester 49,000 (Goodyear)/~0.1 to 0.2 μm, 57 volume percent Pigment:PVB (BMS)/~25 to 30 μm, 50 N,N'-diphenyl-N,N-bis(3-methyl phenyl)-1,1'-biphenyl-4,4'-diamine weight percent: MK (methyl ketone).

A hole transporting layer solution was prepared by dissolving 5.4 grams of N,N'-diphenyl-N,N-bis(3-methyl phenyl)-1,1'-biphenyl-4,4'-diamine, and 8.1 grams of polycarbonate in 61.5 grams of chlorobenzene. The solution was coated onto the HOGaPc Type V generator layer using a 10 mil film applicator. The charge transporting layer thus obtained was dried at 115° C. for 60 minutes to provide a final thickness of about 28 microns.

The xerographic electrical properties (Table 2) of photoresponsive imaging members prepared as described above were determined by electrostatically charging the surface thereof with a corona discharge source until the surface potential, as measured by a capacitatively coupled probe attached to an electrometer, attained an initial dark value, $V_0$, of −800 volts. After resting for 0.5 second in the dark, the charged member reached a surface potential, $V_{ddp}$, or dark development potential. The member was then exposed to filtered light from a Xenon lamp. A reduction in surface potential from $V_{ddp}$ to a background potential, $V_{bg}$, due to the photodischarge effect was observed. The dark decay in volts per second was calculated as $(V_0-V_{ddp})/0.5$. The percent of photodischarge was calculated as $100\times(V_{ddp}-V_{bg})/V_{ddp}$. The half exposure energy, that is $E_{1/2}$, is the amount of exposure energy causing reduction of the $V_{ddp}$ to half of its initial value, was determined. The wavelength of light selected was 780 nanometers.

TABLE 1

Xerographic Electrical Characteristics of Tetrafluoro Hydroxygallium Phthalocyanines

| Conversion Solvent | Polymorphic Form | $V_{ddp}$ (-V) | Dark Decay (-V) | S (V.cm²/erg) | $E_{1/2}$ (ergs/cm²) | $E_{7/8}$ (ergs/cm²) | $V_r$ (-V) |
|---|---|---|---|---|---|---|---|
| Acid pasted JM26591-62 | Type I | Does not charge | | | | | |
| Dimethylformamide JM26591-63-1 | Type II | 816.0 | 18.3 | 64 | 10.4 | 48.5 | 2–26 |
| Dimethylaminoethanol JM26591-63-4 | Type III | 827.5 | 84.7 | 22 | 30.6 | — | 121–230 |
| Isopropanol JM26591-63-7 | Type IV | 393.0 | 127.7 | 22 | 3.40 | 16.1 | 1–17 |
| N-methylpyrrolidone JM26591-63-8 | Type V | 810.0 | 11.4 | 101 | 5.23 | 16.8 | 0–11 |

TABLE 2

Xerographic Electrical Characteristics of Pigment Mixtures

| HOGaPc/(4-F)₄HOGaPc | $V_{ddp}$ (-V) | Dark Decay (V/s) | S (V.cm²/erg) | $E_{1/2}$ (ergs/cm²) | $E_{7/8}$ (ergs/cm²) | $V_r$ (-V) |
|---|---|---|---|---|---|---|
| 0:100 | 806 | 11.0 | 102 | 5.31 | 18.9 | 0–12 |
| 10:90 | 807 | 10.2 | 116 | 4.29 | 13.0 | 0–11 |
| 50:50 | 805 | 7.2 | 209 | 2.24 | 5.40 | 0–15 |
| 90:10 | 802 | 5.0 | 264 | 1.64 | 3.84 | 4–17 |
| 100:0 | 803 | 6.4 | 281 | 1.59 | 3.85 | 7–18 |

Other embodiments and modifications of the present invention may occur to those skilled in the art subsequent to a review of the information presented herein and subsequent to a review of the present application including claims; these embodiments and modifications, as well as equivalents thereof, are also included within the scope of this invention.

What is claimed is:

1. A photoconductive imaging member consisting essentially of a supporting substrate, a photogenerating layer, and a charge transport layer, and wherein said photogenerating layer is comprised of a mixture of a hydroxygallium phthalocyanine and a tetrafluoro hydroxygallium phthalocyanine selected from the group consisting of Type I tetrafluoro hydroxygallium phthalocyanine with an X-ray powder diffraction trace having a major peak at Bragg angles of 6.5, and minor peaks at 15.6, and 26.5 degrees 2Θ, Type II tetrafluoro hydroxygallium phthalocyanine with an X-ray powder diffraction trace having a major peak at Bragg angles of 6.6, and minor peaks at 12.7, 15.4, 26.3, and 27.0 degrees 2Θ, Type III tetrafluoro hydroxygallium phthalocyanine with an X-ray powder diffraction trace having a major peak at Bragg angles of 7.5, and minor peaks at 9.1, 15.6, 16.5, 19.5, 21.8, 22.6, and 27.3 degrees 2Θ, Type IV tetrafluoro hydroxygallium phthalocyanine with an X-ray powder diffraction trace having a major peak at Bragg angles of 6.5, and minor peaks at 7.5, 15.2, 15.7, and 26.5 degrees 2Θ, and Type V tetrafluoro hydroxygallium phthalocyanine with an X-ray powder diffraction trace having a major peak at Bragg angles of 6.6 and minor peaks at 6.0, 13.4, 14.7, 15.9, 16.9, 26.1, and 27.0 degrees 2Θ.

2. A member in accordance with claim 1 wherein said hydroxygallium phthalocyanine is Type V hydroxygallium phthalocyanine, and said tetrafluoro hydroxygallium phthalocyanine is Type V tetrafluoro hydroxygallium phthalocyanine, and wherein said Type V hydroxygallium possesses an X-ray powder diffraction trace with major peaks at 7.4, 9.8, 12.4, 16.2, 17.6, 18.4, 21.9, 23.9, 25.0, 28.1 and with the highest peak at 7.4 degrees 2Θ.

3. A member in accordance with claim 1 wherein the supporting substrate is comprised of a metal, or a polymer.

4. A member in accordance with claim 1 wherein the supporting substrate is aluminum.

5. A member in accordance with claim 1 wherein the charge transport layer is comprised of hole transport molecules.

6. A member in accordance with claim 1 wherein the charge transport layer is comprised of hole transport molecules of the formula

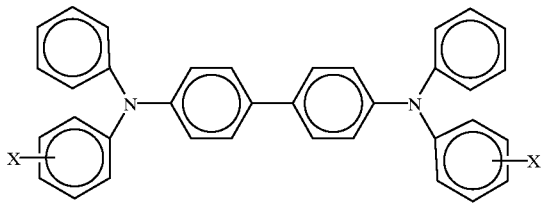

dispersed in a highly insulating and transparent polymer binder, wherein X is an alkyl group or a halogen.

7. A member in accordance with claim 6 wherein halogen is chloro.

8. A member in accordance with claim 1 wherein the charge transport layer is comprised of molecules of N,N'-diphenyl-N,N'-bis(alkylphenyl)-1,1-biphenyl-4,4'-diamine.

9. A member in accordance with claim 1 wherein the charge transport layer is comprised of molecules of N,N'-diphenyl-N,N'-bis(methyl phenyl)-1,1-biphenyl-4,4'-diamine.

10. A member in accordance with claim 1 wherein the tetrafluoro hydroxygallium phthalocyanine is Type V of the following formula

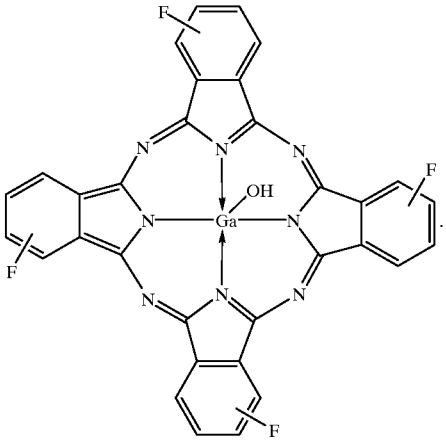

11. A member in accordance with claim 1 wherein the tetrafluoro hydroxygallium phthalocyanine is Type I, II, III, or IV of the following chemical formulas

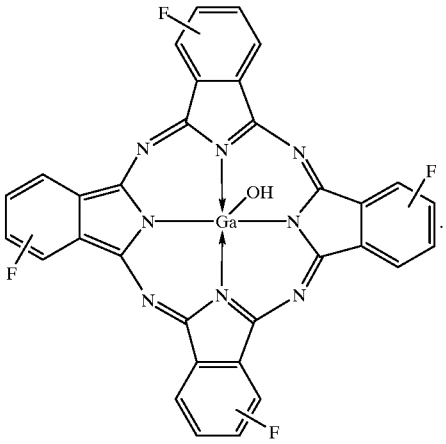

12. A member in accordance with claim 1 wherein the mixtures of the two phthalocyanines are comprised of from about 1 to about 99 weight percent of said tetrafluoro hydroxygallium phthalocyanine, and from about 1 to about 99 weight percent of Type V hydroxygallium phthalocyanine, and subject to the provision that the total of said two components is equal to 100 percent, and wherein said Type V hydroxygallium possesses an X-ray powder diffraction trace with major peaks at 7.4, 9.8, 12.4, 16.2, 17.6, 18.4, 21.9, 23.9, 25.0, 28.1 and with the highest peak at 7.4 degrees 2Θ.

13. A member in accordance with claim 1 wherein the photogenerating layer is in contact with the supporting substrate and the charge transport layer, and is situated therebetween.

14. A member in accordance with claim 1 wherein there is coated on the substrate a blocking layer of from about 0.02 μm to about 1 μm, a photogenerating layer of from about 0.02 μm to about 1 μm, and a charge transport layer of from about 5 μm to about 50 μm.

15. A method of imaging consisting essentially of the generation of an image on the imaging member of claim 1, thereafter developing the image with a toner comprised of resin and pigment, transferring the image to a substrate, and permanently fixing the image thereto.

16. A photoconductive imaging member consisting of a supporting substrate, thereover a photogenerating layer, and a top charge transport layer, and wherein said photogenerating layer consists of a mixture of hydroxygallium Type V phthalocyanine which possesses an X-ray powder diffraction trace with major peaks at 7.4, 9.8, 12.4, 16.2, 17.6, 18.4, 21.9, 23.9, 25.0, 28.1, and with the highest peak at 7.4 degrees 2Θ and a tetrafluoro hydroxygallium phthalocyanine, and wherein said tetrafluoro hydroxygallium phthalocyanine is Type I tetrafluoro hydroxygallium phthalocyanine with an X-ray powder diffraction trace having a major peak at Bragg angles of 6.5, and minor peaks at 15.6, and 26.5 degrees 2Θ; Type II tetrafluoro hydroxygallium phthalocyanine with an X-ray powder diffraction trace having a major peak at Bragg angles of 6.6, and minor peaks at 12.7, 15.4, 26.3, and 27.0 degrees 2Θ; Type III tetrafluoro hydroxygallium phthalocyanine with an X-ray powder diffraction trace having a major peak at Bragg angles of 7.5, and minor peaks at 9.1, 15.6, 16.5, 19.5, 21.8, 22.6, and 27.3 degrees 2Θ; or Type IV tetrafluoro hydroxygallium phthalocyanine with an X-ray powder diffraction trace having a major peak at Bragg angles of 6.5, and minor peaks at 7.5, 15.2, 15.7, and 26.5 degrees 2Θ.

17. A photoconductive imaging member consisting essentially of a supporting substrate, a photogenerating layer, and a charge transport layer, and wherein said photogenerating layer is comprised of a mixture of from 1 weight percent to 99 weight percent Type V tetrafluoro hydroxygallium phthalocyanine and from 1 weight percent to 99 weight percent Type V hydroxygallium phthalocyanine, and subject to the provision that the total of said two phthalocyanine components is equal to 100 percent, and wherein said Type V tetrafluoro hydroxygallium possesses an X-ray powder diffraction trace having a major peak at Bragg angles of 6.6, and minor peaks at 6.0, 13.4, 14.7, 15.9, 16.9, 26.1, and 27.0 degrees 2Θ, and said Type V hydroxygallium phthalocyanine possesses an X-ray powder diffraction trace with major peaks at 7.4, 9.8, 12.4, 16.2, 17.6, 18.4, 21.9, 23.9, 25.0, 28.1 and with the highest peak at 7.4 decrees 2Θ.

18. A member in accordance with claim 17 wherein said charge transport layer is comprised of aryl amine molecules of the formula

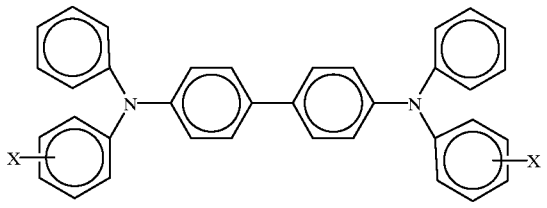

dispersed in a highly insulating and transparent polymer binder, wherein X is an alkyl group or a halogen.

19. A member in accordance with claim 17 wherein the light sensitivity of said photoconductive imaging member is controlled by the ratio amount of the two pigments, Type V tetrafluoro hydroxygallium phthalocyanine and Type V hydroxygallium phthalocyanine.

20. A member in accordance with claim 17 with a tunable light sensitivity of from about 100 $V \cdot cm^2/erg$ to about 280 $V \cdot cm^2/erg$, and with a dark decay of from about 5 to about 20 volts/second, and a residual voltage of from about 0 to about 20 volts, and wherein said imaging member is initially charged to a voltage of about 800 volts.

21. A photoconductive imaging member consisting of a supporting substrate, a photogenerating layer, and a charge transport layer, and wherein said photogenerating layer is comprised of a mixture of a hydroxygallium phthalocyanine and a tetrafluoro hydroxygallium phthalocyanine selected from the group consisting of Type I tetrafluoro hydroxygallium phthalocyanine with an X-ray powder diffraction trace having a major peak at Bragg angles of 6.5, and minor peaks at 15.6, and 26.5 degrees 2Θ, Type II tetrafluoro hydroxygallium phthalocyanine with an X-ray powder diffraction trace having a major peak at Bragg angles of 6.6, and minor peaks at 12.7, 15.4, 26.3, and 27.0 degrees 2Θ, Type III tetrafluoro hydroxygallium phthalocyanine with an X-ray powder diffraction trace having a major peak at Bragg angles of 7.5, and minor peaks at 9.1, 15.6, 16.5, 19.5, 21.8, 22.6, and 27.3 degrees 2Θ, Type IV tetrafluoro hydroxygallium phthalocyanine with an X-ray powder diffraction trace having a major peak at Bragg angles of 6.5, and minor peaks at 7.5, 15.2, 15.7, and 26.5 degrees 2Θ, and Type V tetrafluoro hydroxygallium phthalocyanine with an X-ray powder diffraction trace with minor peaks at 6.0, 13.4, 14.7, 15.9, 16.9, 26.1, and 27.0 degrees 2Θ.

22. A photoconductive imaging member consisting of a supporting substrate, a photogenerating layer, and a charge transport layer, and wherein said photogenerating layer is comprised of a mixture of Type V tetrafluoro hydroxygallium phthalocyanine with an X-ray powder diffraction trace having a major peak at Bragg angles of 6.6, and minor peaks at 6.0, 13.4, 14.7, 15.9, 16.9, 26.1, and 27.0 degrees 2Θ, and said Type V hydroxygallium phthalocyanine possesses an X-ray powder diffraction trace with major peaks at 7.4, 9.8, 12.4, 16.2, 17.6, 18.4, 21.9, 23.9, 25,0, 28.1 and with the highest peak at 7.4 degrees 2Θ.

* * * * *